US007034253B2

(12) United States Patent
Yoshikawa et al.

(10) Patent No.: US 7,034,253 B2
(45) Date of Patent: Apr. 25, 2006

(54) CERAMIC HEATER WITH RING MEMBER ELECTRICALLY CONNECTING THE HEATER TO LEAD TERMINAL CORE ROD

(75) Inventors: Takaya Yoshikawa, Kasugai (JP); Hiroyuki Suzuki, Kasugai (JP); Shinsuke Ito, Konan (JP); Shinya Murakoshi, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 7 days.

(21) Appl. No.: 10/819,183

(22) Filed: Apr. 7, 2004

(65) Prior Publication Data

US 2004/0262282 A1 Dec. 30, 2004

(30) Foreign Application Priority Data

Apr. 7, 2003 (JP) ..... P.2003-103154

(51) Int. Cl.
*F23Q 7/00* (2006.01)
*H05B 3/00* (2006.01)

(52) U.S. Cl. ..... 219/270; 219/544; 219/541; 123/145 A

(58) Field of Classification Search ..... 219/544, 219/270, 541; 123/145 A, 145 R; 361/264–266
See application file for complete search history.

(56) References Cited

U.S. PATENT DOCUMENTS 6,689,990 B1 * 2/2004 Taniguchi et al. ..... 219/270
6,737,612 B1 * 5/2004 Taniguchi et al. ..... 219/270
6,881,930 B1 * 4/2005 Yoshikawa et al. ..... 219/270
6,900,412 B1 * 5/2005 Taniguchi et al. ..... 219/270

FOREIGN PATENT DOCUMENTS

| | | | |
|---|---|---|---|
| JP | 9-42671 A | | 2/1997 |
| JP | 2002-364841 A | | 12/2002 |
| JP | 2002-364843 | * | 12/2002 |
| JP | 2003-56848 | * | 2/2003 |
| JP | 2003-74849 | * | 3/2003 |

* cited by examiner

*Primary Examiner*—John A. Jeffery
(74) *Attorney, Agent, or Firm*—Sughrue Mion, PLLC

(57) ABSTRACT

A heater including: a rod-shaped ceramic heater including: a ceramic heater body extending in an axial direction and having a heating-element at its leading end portion for generating heat when energized; and first and second energizing lead terminals extending from the heating element and exposed to an outer circumference of a trailing end side of the ceramic heater body; a cylindrical outer cylinder for holding the ceramic heater while protruding a leading end portion and a trailing end portion of the ceramic heater; and a core rod arranged on said trailing end side of the ceramic heater in an axial direction and connected electrically with the first lead terminal, wherein the heater further includes: a ring member including: a ring leading end portion fixed by a tight fitting on an outer circumference of a trailing end side of the ceramic heater and connected electrically with the first lead terminal; and a ring trailing end portion protruding backward from a trailing end of the ceramic heater; and a metallic lead for connecting the ring trailing end portion and the core rod electrically.

17 Claims, 7 Drawing Sheets

CERAMIC HEATER WITH RING MEMBER ELECTRICALLY CONNECTING THE HEATER TO LEAD TERMINAL CORE ROD

FIELD OF TH INVENTION

The present invention relates to a ceramic glow plug for preheating the inside of the cylinder of a Diesel engine or a heating plug for preheating water.

BACKGROUND OF THE INVENTION

The heater of the related art comprises a rod-shaped ceramic heater including: a ceramic heater body extending in the axial direction and having a heating element at the leading end portion thereof for generating heat when energized; and a pair of energizing lead terminals extending from the heating element and exposed to the outer circumference of the trailing end side of the ceramic heater body. Moreover, the ceramic heater is energized through a core rod arranged on the trailing end side of the ceramic heater in the axial direction and through a metallic lead connecting the core rod and one of the lead terminals of the ceramic heater (as referred to JP-A-2002-364841 (FIG. 1)).

SUMMARY OF THE INVENTION

In the heater of JP-A-2002-364841 (FIG. 1), the joint between the ceramic heater and the metallic lead is performed by fixing the ring member as a whole by a tight fitting on the outer circumference of the trailing end side of the ceramic heater and by soldering or welding one end of the metallic lead to the outer circumference of the ring member. However, the ring member thus fixed on the ceramic heater by the tight fitting is subject to a stress in its circumferential direction. In case the metallic lead is further jointed to the outer circumference of the tightly fitted portion of the ring member, the stress due to the difference between the coefficients of thermal expansion between the ring member and the metallic lead is further superposed over the circumferential stress. As a result, the repeated use of the ceramic heater may crack the ring member at its portion jointed to the metallic lead. Moreover, the two stresses (i.e., the circumferential stress and the stress due to the difference between the thermal expansion coefficients) enlarge the cracks, and the metallic lead may come out from the ring member. Alternatively, the ring member may come out from the ceramic heater. As a result, the electric conduction may not be attained.

The present invention has been conceived in view of those problems and has an object to provide a heater, which can ensure the electric conduction between the ring member and the metallic lead even if the stresses are applied.

In order to achieve this object, according to one mode of the present invention, there is provided a heater comprising: a rod-shaped ceramic heater including: a ceramic heater body extending in the axial direction and having a heating element at its leading end portion for generating heat when energized; and first and second energizing lead terminals extending from the heating element and exposed to the outer circumference of the trailing end side of the ceramic heater body; a cylindrical outer cylinder for holding the ceramic heater while protruding the leading end portion and the trailing end portion of the ceramic heater; and a core rod arranged on the trailing end side of the ceramic heater in the axial direction and connected electrically with the first lead terminal, wherein the improvement comprises: a ring member including: a ring leading end portion fixed by a tight fitting on the outer circumference of the trailing end side of the ceramic heater and connected electrically with the first lead terminal; and a ring trailing end portion protruding backward from the trailing end of the ceramic heater; and a metallic lead for connecting the ring trailing end portion and the core rod electrically.

In the heater of the invention, not the entire ring but the ring leading end portion is fixed by the tight fitting on the outer circumference of the trailing end side of the ceramic heater thereby to connect the ring trailing end portion and the metallic lead electrically. In the ring member, more specifically, the portion to contribute to the tight fitting and the portion to contribute to the electric connection with the metallic lead are made different. Thus, the stress due to the thermal expansion difference between the metallic lead and the ring member is not superposed over the leading end portion, in which the stress is caused in the circumferential direction by the tight fitting, so that the ring member can be prevented from cracking. Therefore, it is possible to provide a heater having a high reliability for the electric conduction. This effect is most prominent in the tight fitting, which might otherwise be subject to the thermal stress, but can also be attained in case the ring leading end portion and the outer circumference of the trailing end side of the heater are soldered. Here, the tight fitting is conceived to cover the press fitting, the shrinkage fitting or the expansion fitting.

Moreover, the ring leading end portion may be tightly fitted at least 15% of the ring member, when viewed in the in the axial direction of the ceramic heater. Below 15%, the tight fitting allowance with the ceramic heater may be reduced to crack the ring member. On the other hand, the tight fitting of the ring member is preferred to be not more than 90%. Over 90%, the ring trailing end portion may be reduced to reduce the joint portion to the core rod. Then, it may also be impossible to achieve the stress reducing effect efficiently.

In the beater of the invention, the ring trailing end portion and the metallic lead is preferably connected to each other by a welding.

By thus welding, the ring member and the metallic lead can be more firmly jointed to each other. As a result, the metallic lead can be prevented from coming out from the ring member thereby to provide a heater having a higher reliability for the electric conduction. Here, the ring member and the metallic lead may be welded by a resistance welding, an ultrasonic welding or a laser welding.

On the other hand, the metallic lead and the core rod may be jointed by a welding such as the resistance welding, the ultrasonic welding or the laser welding, by brazing or by soldering. Moreover, the ring member and the metallic lead, and the metallic lead and the core rod may also be individually jointed either directly or through another member. In short, it is sufficient that the ring member and the metallic lead, and the metallic lead and the core rod are individually electrically connected with each other.

In the heater of the invention, the metallic lead is preferably connected by a welding to the inner circumference of the ring trailing end portion.

Thus, the ring member and the metallic lead are welded on the inner circumference of the ring trailing end portion thereby to eliminate the space for the metallic lead to be welded to the outer circumference of the ring member, so that the heater itself can be radially reduced.

In order to achieve that object, according to another mode of the present invention, there is provided a heater comprising: a rod-shaped ceramic heater including: a ceramic heater body extending in the axial direction and having a heating element at its leading end portion for generating heat when energized; and first and second energizing lead terminals extending from the heating element and exposed to the outer circumference of the trailing end side of the ceramic heater body; a cylindrical outer cylinder for holding the ceramic heater while protruding the leading end portion and the trailing end portion of the ceramic heater; and a core rod arranged on the trailing end side of the ceramic heater in the axial direction and connected electrically with the first lead terminal, wherein the improvement comprises: a ring member including: a ring leading end portion fixed by a tight fitting on the outer circumference of the trailing end side of the ceramic heater and connected electrically with the first lead terminal; and a ring trailing end portion jointed to the outer circumference of the core rod.

In the heater of the invention, the ring leading end portion is fixed by the right fitting on the outer circumference of the trailing end side of the ceramic heater, and the ring trailing end portion is jointed to the core rod. In other words, the ring member is jointed on its trailing end side directly to the core rod thereby to cause no stress due to the thermal expansion difference between the ring member and the metallic lead. As a result, the stress due to the thermal expansion difference is not superposed over the leading end portion, in which the stress might otherwise be caused in the circumferential direction by the tight fitting, so that no cracking occurs in the ring member. Therefore, it is possible to provide a heater having a high reliability for the electric conduction.

Here, the ring leading end portion is tightly fitted preferably on 15% or more of the ring member, as viewed in the axial direction of the ceramic heater. Below 15%, the tight fitting allowance with the ceramic heater may be reduced to crack the ring member. Moreover, the tight fitting of the ring member is preferred to be not more than 90%. Over 90%, the ring trailing end portion maybe reduced to reduce the joint portion to the core rod. Then, it may also be impossible to achieve the stress reducing effect efficiently.

In the heater, the ring leading end portion is preferably fixed by a press-fitting on the trailing end portion of the ceramic heater. As a result, the ring member is not affected the beat so that the ring member can be fixed on the ceramic heater without being softened (or annealed) by the heat, Even if the heater vibrates, therefore, the ring member is not deformed to cause neither contact with the main fitting nor disconnection.

In case the ring member of the heater is jointed to the ceramic heater by the press fitting, moreover, the ring trailing end portion and the core rod is preferably jointed to each other by a welding. When the ring member is to be press-fitted in the ceramic heater, the ring member does not become soft, as described above. It is, therefore, difficult to joint the ring trailing end portion to the core rod by additionally fasten to deform it. Therefore, the ring member and the core rod can be jointed easily and firmly to each other by welding them. It is also possible to prevent the ring member from coming out from the core rod. Here, the ring member and the core rod may be welded by the resistance welding, the ultrasonic welding or the laser welding. It is sufficient to connect the metallic lead and the ring member electrically.

In the heater, moreover, the ring trailing end portion and the core rod are preferably jointed to each other by a laser welding at least all over the circumference. Thus, the rod-shaped core rod and the cylindrical ring member can be easily jointed with the laser beam. Moreover, the laser welding is performed all over the circumference so that it can be strengthened to prevent the ring member further from coming out from the core rod.

DESCRIPTION OF REFERENCE NUMERALS AND SIGNS

1, 300, 400, 500 - - - GLOW PLUG, 2 - - - CERAMIC HEATER, 21 - - - CERAMIC HEATER BODY, 22 - - - HEATING ELEMENT, 23 - - - FIRST LEAD TERMINAL, 24 - - - SECOND LEAD TERMINAL, 3, 403, 503 - - - OUTER CYLINDER, 31 - - - BULGING PORTION, 4 - - - MAIN FITTING, 5 - - - CORE ROD, 46 - - - CERAMIC RING, 7 - - - GLASS-FILLED LAYER, 8 - - - INSULATING BUSHING, 9 - - - TERMINAL FITTING, 10, 310 - - - RING MEMBER, 101, 311 - - - LEADING END PORTION, 102, 312 - - - TRAILING END PORTION, 200 - - - COMPOSITE MOLDING, 211, 212 - - - SPLIT MOLDING, 220 - - - HEATING ELEMENT POWDER MOLDING.

DETAILED DESCRIPTION OF THE INVENTION

EMBODIMENT 1

Embodiment 1 of the invention will be described with reference to the accompanying drawings.

Figure 1:
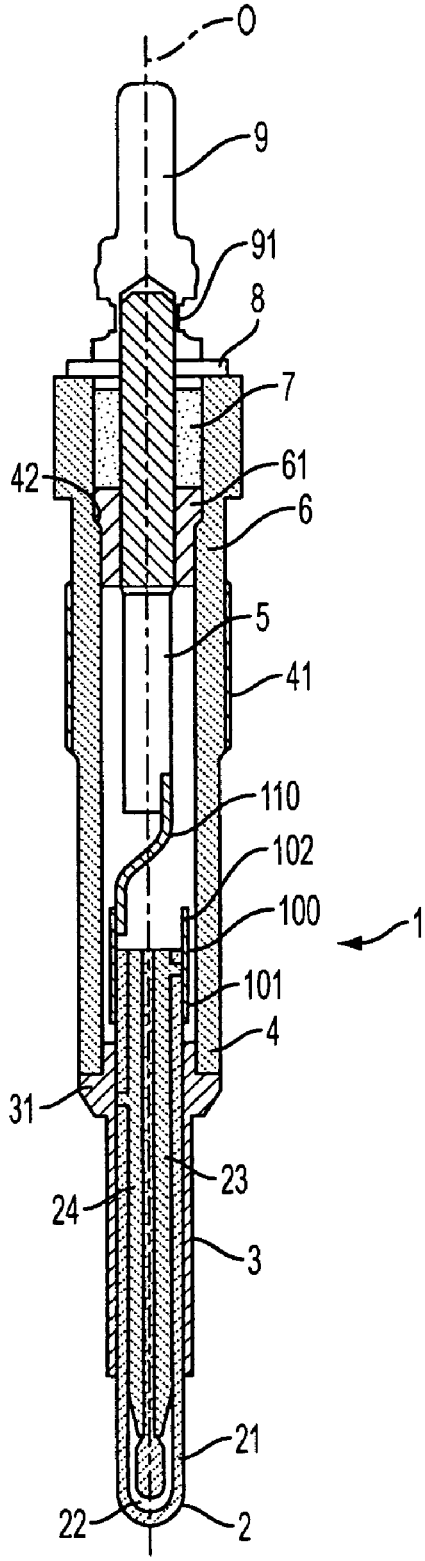
FIG. 1 is a longitudinal section of a glow plug 1 according to Embodiment 1 of the invention.
Figure 2:
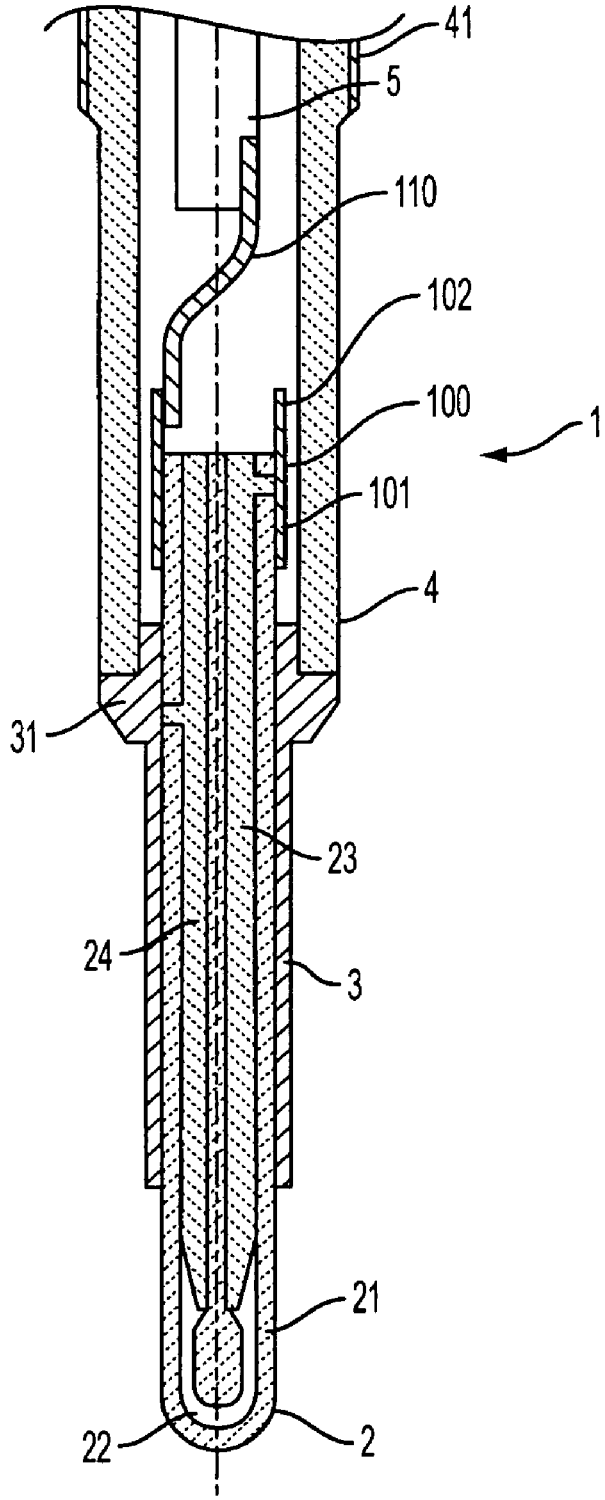
FIG. 2 is a longitudinal section showing an essential portion of FIG. 1.

FIG. 1 shows an internal structure of a glow plug 1 exemplifying the heater of the invention. On the other hand, FIG. 2 shows an essential portion in an enlarged scale. The glow plug 1 includes: a ceramic heater 2; an outer cylinder 3 holding the ceramic heater 2; a main fitting 4 holding the outer cylinder 3; and a core rod 5 arranged on the trailing end side of the ceramic heater 2.

In the ceramic beater 2, a heating element 22 is buried in the leading end portion of a ceramic heater body 21 having a rod shape, and a first leading end 23 and a second lead terminal 24 of one pair for energizing the heating element 22 are exposed to the outer circumference of the trailing end portion of the ceramic heater body 21. This ceramic heater body 21 is made of insulating ceramics composed mainly of silicon nitride ($Si_3N_4$). The heating element 22 is made of a mixture of conductive ceramics such as tungsten carbide (WC), molybdenum silicide ($MoSi_2$) or tungsten silicide and insulating ceramics and is formed into a U-shape. On the other hand, the first and second lead terminals are made of a mixture of conductive ceramics having an electric resistivity different from that of the heating element 22 and insulating ceramics.

The outer cylinder 3 is a cylindrical member made of stainless steel such as SUS630 or SUS430 and having a radially bulging portion 31, and holds the ceramic heater 2 on its inner side while protruding the leading end portion and the trailing end portion of the ceramic heater 2. By jointing the leading end face of the main fitting 4 made of S40C and the trailing end face of the bulging portion 31, moreover, the trailing end side of the bulging portion 31 of the outer cylinder 3 is fitted on the main fitting 4. As a result, the outer cylinder 3 can be easily positioned at its fitted position. On the other hand, the outer cylinder 3 and the second lead terminal 24 are connected mechanically and electrically to each other.

Moreover, the main fitting 4 is provided in its outer circumference with a threaded portion 41 for fixing the glow plug 1 in the not-shown engine block. The core rod 5 is attached to the trailing end side of the main fitting 4. Here, when the glow plug 1 is fixed in the engine block, the bulging portion 31 of the outer cylinder 3 is brought into abutment against the fixing portion of the engine block.

Next, the core rod 5 is arranged while being insulated from the main fitting 4. A ceramic ring 6 is arranged between the outer circumference of the trailing end portion of the core rod 5 and the inner circumference of the main fitting 4 thereby to fix a glass-filled layer 7 on the trailing end side of the ceramic ring 6. Here, the ceramic ring 6 is provided on its outer circumference with a ring-side engagement portion 61 having an radially enlarged shape. This engagement portion 61 engages with a fitting-side engagement portion 42, which is formed in a circumferential step shape on the inner circumference of the main fitting 4 close to the inner circumference, thereby to prevent the ceramic ring 6 from coming out to the leading end side. On the other hand, the outer circumference portion of the core rod 5 to contact with the glass-filled layer 7 is knurled rough. Moreover, the trailing end portion of the core rod 5 is protruded backward of the main fitting 4, and a terminal fitting 9 is fitted on that protrusion through an insulating bushing 8. The terminal fitting 9 is fixed in a conductive state on the outer circumference of the core rod 5 by an additionally fastened portion 91 in the circumferential direction.

On the other hand, a ring leading end portion 101 made of stainless steel such as SUS630 or SUS430 and conducting with the first lead terminal 23 is so attached in a tightly fitted state to the outer circumference of the trailing end portion of the ceramic heater 2 as to cover the first lead terminal 23. Moreover, the core rod 5 and a ring member 100 are electrically connected with each other by a metallic lead 110, which is welded at its one end to the inner circumference of a ring trailing end portion 102 and at its other end to the core rod 5. As a result, the metallic lead 110 is not tightly fitted to the ring leading end portion 101, which is subject to a circumferential stress, but to the ring trailing end portion 102 not in the tightly fitted state, so that stress to be applied to the ring member 100 can be dispersed to prevent the ring member 100 from cracking. Moreover, the ring member 100 and the metallic lead 110 are welded to each other so that they can be more firmly bonded to each other. Still moreover, the metallic lead 110 is jointed to the inner circumference of the ring trailing end portion 102 so that the glow plug 1 can be made radially small.

Figure 3A:
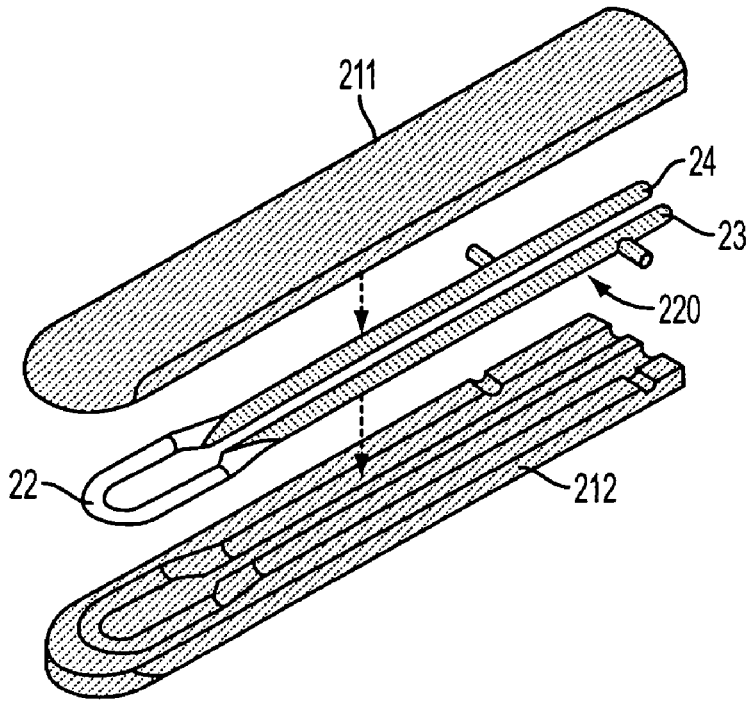
FIGS. 3A and 3B are explanatory diagrams of a process for preparing a ceramic heater 2 of the glow plug 1.
Figure 3B:
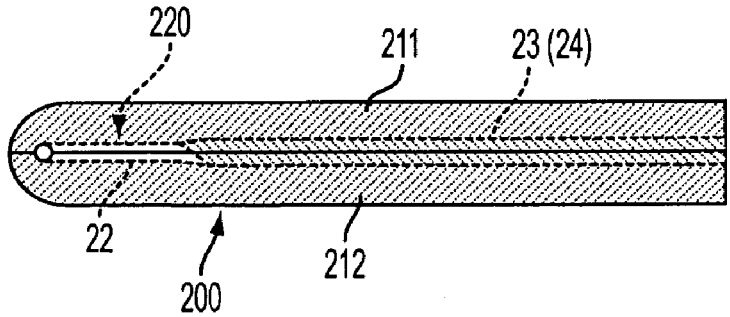

A method for manufacturing the glow plug 1 will be described in the following. First of all, an integrated powder molding 220 having the beating element 22 and the first and second lead terminals 23 and 24 is prepared by an injection molding, as shown in FIG. 3A. Split moldings 211 and 212 are also prepared as vertically separate body moldings by molding material powder for the ceramic heater body 21 in advance by a die-pressing molding. Cavities shaped to correspond to the heating element powder molding 220 are formed in the mating faces of those split moldings 211 and 212. The heating element powder molding 220 is confined in those cavities, and the split preparatory moldings 211 and 212 are fitted on those mating faces. The split moldings 211 and 212 are pressed/compressed to form their integrated composite molding 200, as shown in FIG. 3B.

Figure 4:
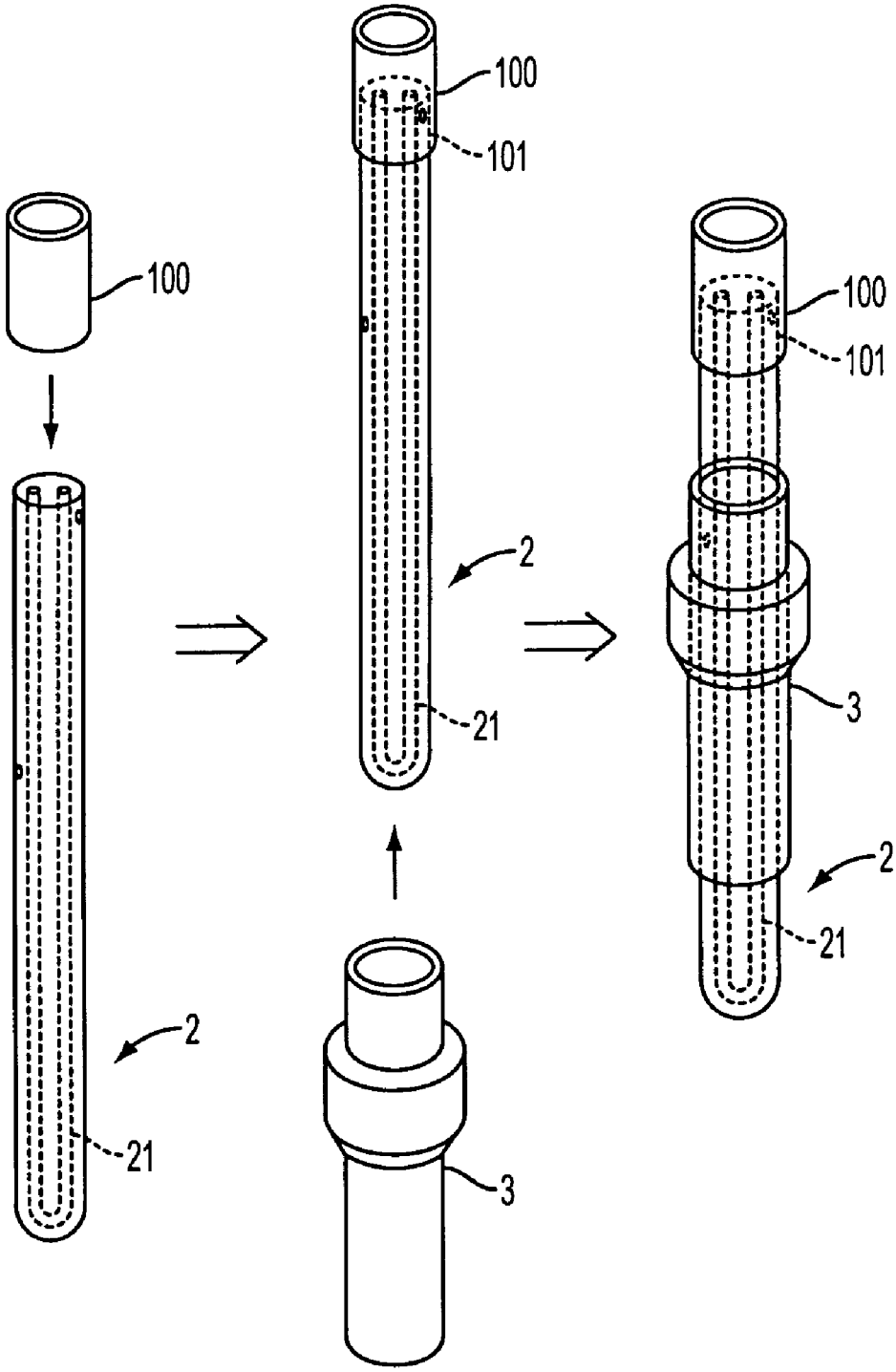
FIG. 4 is an explanatory diagram of the process subsequent to FIG. 3, for manufacturing the glow plug 1.

The composite molding 200 thus obtained is subjected to a binder removing treatment and is sintered at 1,700° C. or higher, e.g., at about 1,800° C. by a hot pressing treatment thereby to prepare a sintered structure. This structure is polished on its outer circumference into a cylindrical shape so that the ceramic heater 2 is obtained. As shown in FIG. 4, the ring leading end portion 101 is so tightly fitted by a press-fitting or the like that it may be electrically connected with the first lead terminal 23. Moreover, the ceramic heater 2 is likewise so tightly fitted in the outer cylinder 3 by a press-fitting or the like that it may be electrically connected with the second lead terminal 24.

Then, the metallic lead 110 is welded at its one end to the ring trailing end portion 102 by a resistance welding or the like. After this, the other end of the metallic lead 110 is welded to the leading end side of the core rod 5 by a resistance welding or the like. When the main fitting 4 and the necessary parts are assembled by the well-known method, the glow plug 1 is completed, as shown in FIG. 1.

EMBODIMENT 2

Embodiment 2 of the invention will be described with reference to the accompanying drawings.

Here, a glow plug 300 of Embodiment 2 is different mainly in the jointed-portion between the ceramic heater 2 and the core rod 5 from the glow plug 1 of Embodiment 1, but the its remaining portions are substantially similar. Therefore, the description will be made centrally on the different-portions but will omitted or simplified on the similar portions.

Figure 5:
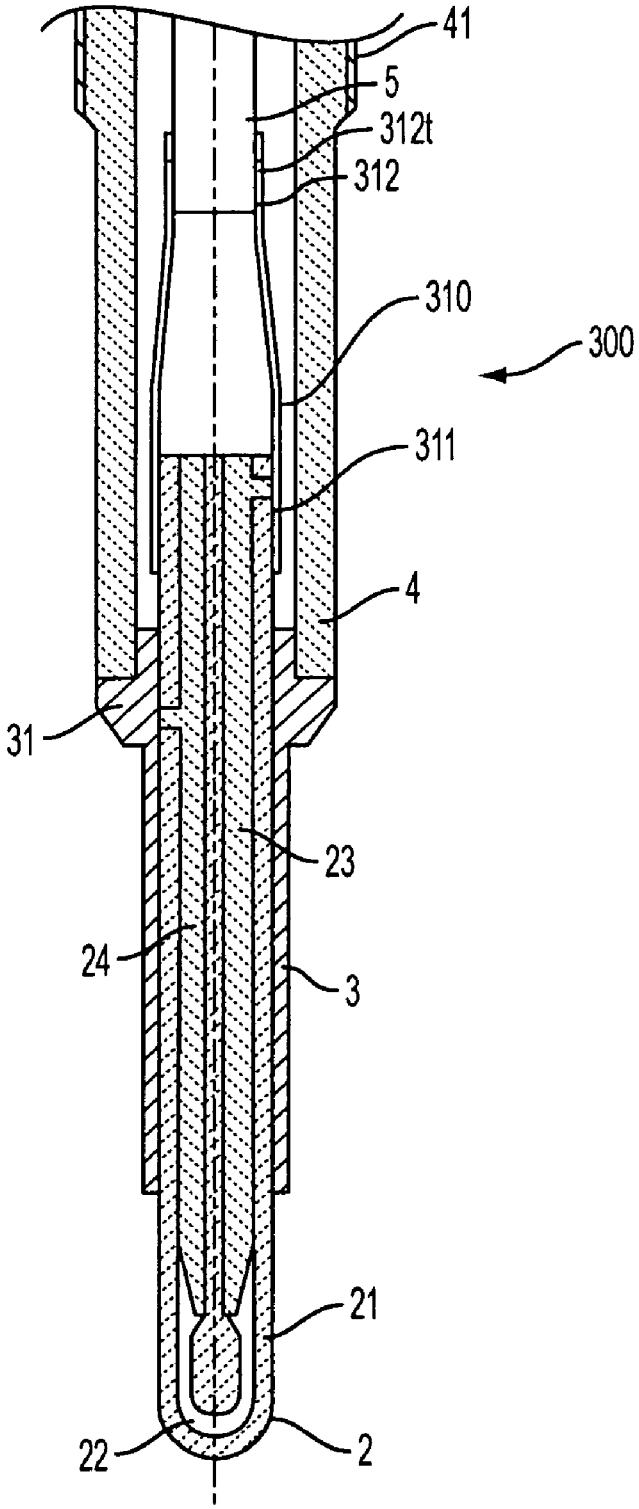
FIG. 5 is a longitudinal section of a glow plug 300 according to Embodiment 2 of the invention.

FIG. 5 shows the internal structure of an essential portion of the glow plug 300 or one example of the heater of the invention. A ring member 310 made of stainless steel such as SUS630 or SUS430 for conducting with the first lead terminal 23 is so tightly press-fitted at its leading end portion 311 on the outer circumference of the trailing end portion of the ceramic heater 2 as to cover the first lead terminal 23. Moreover, the ring member 310 is extended at its trailing end portion 312 directly over the core rod 5, and the trailing end portion 312 and the core rod 5 are jointed to each other by a welding. Specifically, the trailing end portion 312 and the core rod 5 are jointed at their overlapping portion 312*t* throughout the circumference by a laser welding. As a result, the stress due to the difference in the thermal expansion between the ring member 310 and the metallic lead is not superposed over the leading end portion 311 of the ring member 310, in which a stress is circumferentially generated by the tight fitting. The ring member 310 can be prevented from cracking thereby to provide a heater having a high reliability for the electric conduction. Moreover, the ring leading end portion is press-fitted and fixed on the trailing end portion of the ceramic heater so that the ring member can be fixed in the ceramic heater without being thermally affected. As a result, the ring zaneer is prevented from being deformed, even when the heater vibrates, thereby to eliminate the disconnection or the like, which might otherwise be caused by the contact with the main fitting. Moreover, the ring trailing end portion and the core rod are welded so that they can be firmly jointed to each other thereby to prevent the ring member from coming out from the core rod. Here, the ring member 310 is made so thinner than the outer cylinder 3 that it may have a suitable elastic force.

EXAMPLES

Here will be described the results of experiments, which were performed to confirm the effects of the invention. First of all, the ceramic heater of the mode shown in FIG. 1 was manufactured by the method thus far described. Here, the ceramic heater was made substantially into a rod shape having a length of 40 mm and an external diameter of 3.5 mm.

The aforementioned SUS630 was used to make the ring member. The ring member prepared had an external diameter of 4.2 mm and an internal diameter of 3.4 mm. The ring member was press-fitted on the outer circumference of the trailing end side of the ceramic heater.

There were manufactured: the glow plug (of the related art), in which the ring member was press-fitted on the trailing end portion of the ceramic heater to joint the metallic lead of Ni to the ring member; the glow plug (of Embodiment 1), in which the ring leading end portion was press-fitted on the trailing end portion of the ceramic heater to joint the ring trailing end portion and the metallic lead; and the glow plug (of Embodiment 2), in which the ring leading end portion was press-fitted on the trailing end portion of the ceramic heater to joint the ring trailing end portion directly to the core rod. Here, the ring member of the related art had a length of 4 mm, and the ring member of Embodiment 1 had a length of 8 mm and a leading end portion length of 6 mm. Moreover, the ring member of Embodiment 2 had a length of 12 mm and a leading end portion length of 5 mm. The joint portion between the core rod and the ring member had a length of 5 mm.

Individually twenty five glow plugs of the related art (Sample Nos. 1, 2 and 3), Embodiment 1 (Sample Nos. 4, 5 and 6) and Embodiment 2 (Sample Nos. 7, 8 and 9) were energized (at 7.5 V) continuously for one minute and were then forcedly quenched to the room temperature for one minute. These treatments were repeated by 200,000 cycles. The numbers of glow plugs having cracking ring members after the tests were counted. The highest temperature by the energization, the defective numbers and the percent defectives are enumerated in Table 1.

| Sample No. | Test Temp. | Test No. | Defective No. | Percent Defective |
|---|---|---|---|---|
| 1 | 300 | 25 | 2 | 8 |
| 2 | 325 | 25 | 6 | 24 |
| 3 | 350 | 25 | 9 | 36 |
| 4 | 300 | 25 | 0 | 0 |
| 5 | 325 | 25 | 0 | 0 |
| 6 | 350 | 25 | 0 | 0 |
| 7 | 300 | 25 | 0 | 0 |
| 8 | 325 | 25 | 0 | 0 |
| 9 | 350 | 25 | 0 | 0 |

Test Temp.: ° C.

According to Table 1, the cracking occurred in the (two, six and nine) ring members of Samples Nos. 1, 2 and 3 for comparison, but no cracking occurred in Embodiment 1 and Embodiment 2. Therefore, Embodiment 1 and Embodiment 2 can prevent the ring members from cracking thereby to provide a heater having a high reliability for the electric conduction.

Next, there were prepared: the ceramic heater having an external diameter of 3.5 mm; a core rod made of SUS430 and having a length of 90 mm and a diameter of 4.2 mm; and a ring member made of SUS630 like that of Embodiment 1. Here, the ring member had an external diameter of 4.2 mm, an internal diameter of 3.4 mm and a length L of 12 mm. Moreover, the ceramic heater and the ring member were jointed by the press-fitting, and the core rod and the ring member were jointed by the laser welding. Here, the jointed portion between the core rod and the ring member had a length of 5 mm, and the jointed portion between the ring member and the ceramic heater had a length of L1 mm, as enumerated in Table 2.

The aforementioned Samples of Table 2 were manufactured individually by twenty five, and the leading end portions of the ceramic heaters were vibrated at 50 G (50×9.8 mgf) for 100 hours. Then, the Samples, in which the ceramic heater had come out from the ring member, were decided defective, and the numbers of defectives were counted, as enumerated in Table 2.

TABLE 2

| Sample No. | L1 | L1/L (%) | Defective No. | Percent (%) Defective |
|---|---|---|---|---|
| 1 | 1.2 | 10.0 | 17 | 68 |
| 2 | 1.5 | 12.5 | 8 | 32 |
| 3 | 1.8 | 15.0 | 0 | 0 |
| 4 | 2.1 | 17.5 | 0 | 0 |
| 5 | 2.4 | 20.0 | 0 | 0 |

According to Table 2, defectives occurred in Samples having less than 15% of the press-fitted portion of the ring member on the ceramic heater. On the contrary, Samples excess of 15% had no defective. Thus, it is possible to provide a heater having a high reliability for the electric conduction between the ring member and the ceramic heater.

Figure 6:
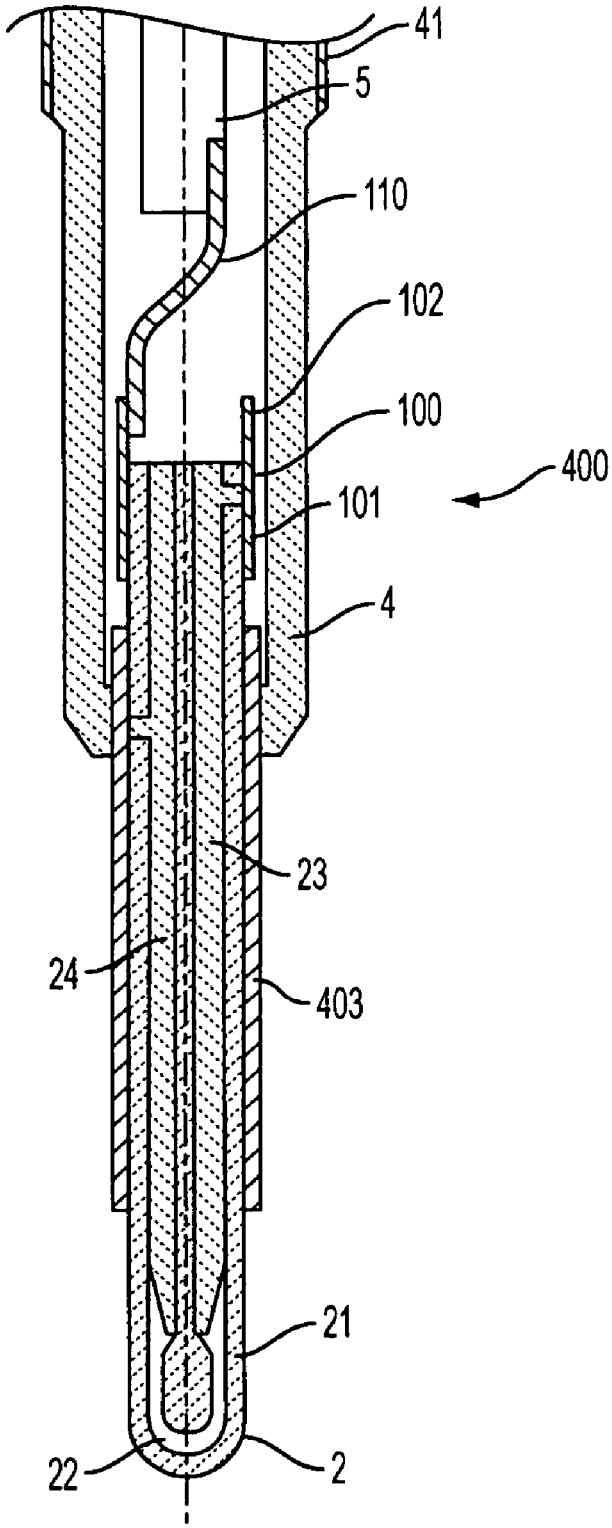
FIG. 6 is a longitudinal section showing a first modification of the glow plug 1 of FIG. 1.
Figure 7:
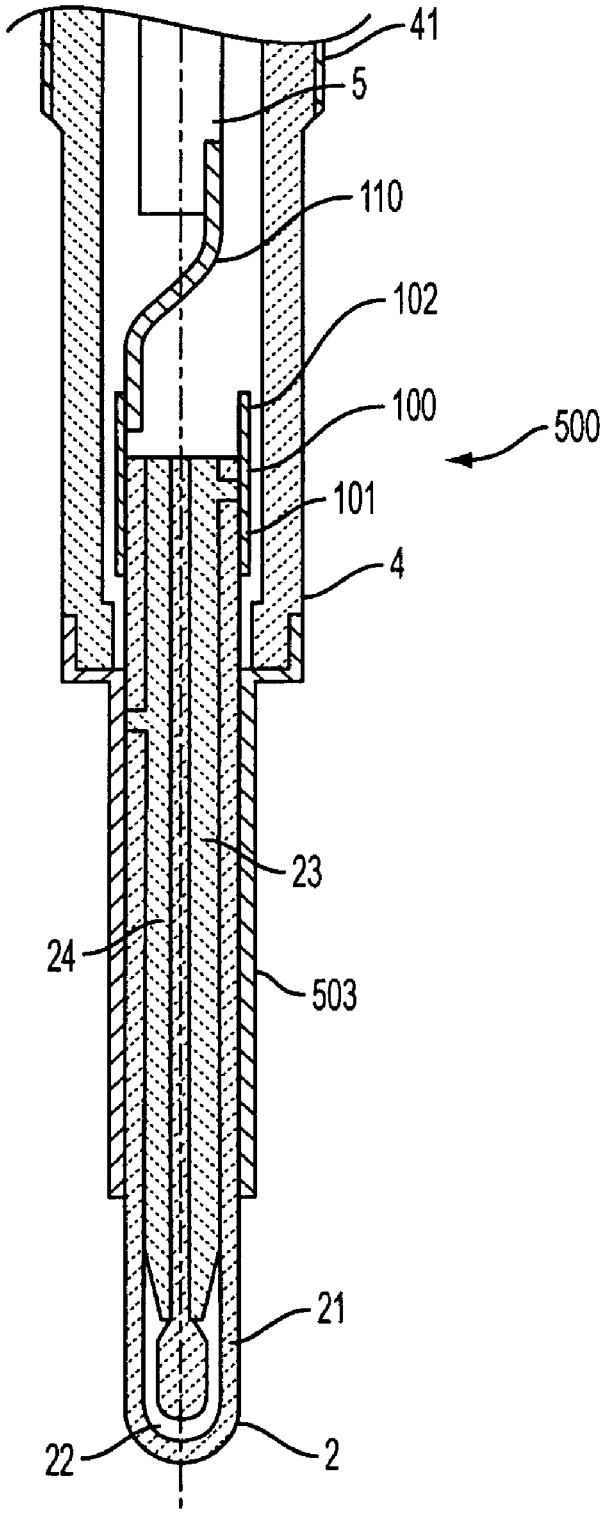
FIG. 7 is a longitudinal section showing a second modification of the glow plug 1 of FIG. 1.

Here, the invention should not be limited to the specific embodiments thus far described but can be modified into various embodiments within the scope thereof. In the glow plug 1 of Embodiment 1, for example, the outer cylinder 3 is provided with the bulging portion 31. However, the invention should not be limited thereto but may be provided with a cylindrical outer cylinder 403, as shown in FIG. 6. This modification can reduces the number of steps of making the outer cylinder thereby to lower the cost. Alternatively, the glow plug 1 may also be provided an outer cylinder 503 having a trailing end side cylinder radially enlarged, as shown in FIG. 7. In this modification, the outer cylinder can be easily positioned by fixing the leading end of the main fitting at the boundary portion between the radially enlarged and reduced portions of the outer cylinder.

In the glow plug 1 of Embodiment 1, the heating element 22 is buried in the ceramic heater body 21. However, the glow plug 1 should not be limited thereto, but the heating element 22 may also be exposed to the outer circumference of the leading end portion of the ceramic heater body 21.

Moreover, the embodiments are exemplified by the glow plugs. However, the invention should not be limited to the glow plugs but could also be applied to a water heater for heating water or oil.

This application is based on Japanese Patent application JP 2003-103154, filed Apr. 7, 2003, and Japanese Patent application JP 2004-43379, filed Feb. 19, 2004, the entire contents of which are hereby incorporated by reference, the same as if set forth at length.

What is claimed is:

1. A heater comprising:

a rod-shaped ceramic heater including: a ceramic heater body extending in an axial direction and having a heating element at its leading end portion for generating heat when energized; and first and second energizing lead terminals extending from said heating element and exposed to an outer circumference of a trailing end side of said ceramic heater body;

a cylindrical outer cylinder for holding said ceramic heater while protruding a leading end portion and a trailing end portion of said ceramic heater; and a core rod arranged on said trailing end side of said ceramic heater in an axial direction and connected electrically with said first lead terminal, wherein said heater further comprises:

a ring member including: a ring leading end portion fixed by a tight fitting on an outer circumference of a trailing end side of said ceramic heater and connected electrically with said first lead terminal; and a ring trailing end portion protruding backward from a trailing end of said ceramic heater; and a metallic lead for connecting said ring trailing end portion and said core rod electrically.

2. The heater according to claim 1, wherein said ring trailing end portion and said metallic lead are connected to each other by a welding.

3. The heater according to claim 1, wherein said metallic lead is connected by a welding to an inner circumference of said ring trailing end portion.

4. The heater according to claim 1, wherein said second lead terminal is electrically connected with said outer cylinder.

5. A heater comprising:

a rod-shaped ceramic heater including: a ceramic heater body extending in an axial direction and having a heating element at its leading end portion for generating heat when energized; and first and second energizing lead terminals extending from said heating element and exposed to an outer circumference of a trailing end side of said ceramic heater body;

a cylindrical outer cylinder for holding said ceramic heater while protruding a leading end portion and a trailing end portion of said ceramic heater; and a core rod arranged on a trailing end side of said ceramic heater in an axial direction and connected electrically with said first lead terminal, wherein the heater further comprises:

a ring member including: a ring leading end portion fixed on an outer circumference of a trailing end side of said ceramic heater and connected electrically with said first lead terminal;

and a ring trailing end portion protruding backward from a trailing end of said ceramic heater; and a metallic lead for connecting an inner circumference of said ring trailing end portion and said core rod electrically.

6. The heater according to claim 5, wherein said ring trailing end portion and said metallic lead are welded to each other.

7. The heater according to claim 5, wherein said metallic lead and said core rod are welded to each other.

8. The heater according to claim 5, wherein said second lead terminal is electrically connected with said outer cylinder.

9. A heater comprising:

a rod-shaped ceramic heater including: a ceramic heater body extending in an axial direction and having a heating element at its leading end portion for generating heat when energized; and first and second energizing lead terminals extending from said heating element and exposed to an outer circumference of a trailing end side of said ceramic heater body;

a cylindrical outer cylinder for holding said ceramic heater while protruding a leading end portion and a trailing end portion of said ceramic heater; and a core rod arranged on a trailing end side of said ceramic heater in an axial direction and connected electrically with said first lead terminal, wherein the heater further comprises:

a ring member including: a ring leading end portion fixed by a tight fitting on an outer circumference of a trailing end side of said ceramic heater and connected electrically with said first lead terminal; and a ring trailing end portion jointed to an outer circumference of said core rod by a welding.

10. The heater according to claim 9 wherein 15% or more of said ring member is tightly fitted on the trailing end side of the ceramic heater, as viewed in an axial direction of said ceramic heater.

11. The heater according to claim 9, wherein said ring leading end portion is fixed by a press-fitting on a trailing end portion of said ceramic heater.

12. The heater according claim 9, wherein said ring trailing end portion and said core rod are jointed to each other by a laser welding at least all over a circumference.

13. The heater according to claim 9, wherein said second lead terminal is electrically connected with said outer cylinder.

14. The heater according to claim 9, wherein said ring member has a thickness smaller than that of said outer cylinder.

15. A heater comprising:

a rod-shaped ceramic heater including: a ceramic heater body extending in an axial direction and having a heating element at its leading end portion for generating heat when energized; and first and second energizing lead terminals extending from said heating element and exposed to an outer circumference of a trailing end side of said ceramic heater body;

a cylindrical outer cylinder for holding said ceramic heater while protruding a leading end portion and a trailing end portion of said ceramic heater; and a core rod arranged on a trailing end side of said ceramic heater in an axial direction and connected electrically with said first lead terminal, wherein the heater further comprises:

a ring member including: a ring leading end portion fixed on an outer circumference of a trailing end side of said ceramic heater and connected electrically with said first lead terminal;

and a ring trailing end portion welded to an outer circumference of said core rod.

16. The heater according to claim 15, wherein said second lead terminal is electrically connected with said outer cylinder.

17. The heater according to claim 15, wherein said ring member has a thickness smaller than that of said outer cylinder.

* * * * *